US010231544B2

(12) United States Patent
Reinhart

(10) Patent No.: US 10,231,544 B2
(45) Date of Patent: Mar. 19, 2019

(54) SHELF PRODUCT

(71) Applicant: Creative Plastic Concepts, LLC, Sycamore, OH (US)

(72) Inventor: Nickolas Reinhart, Findlay, OH (US)

(73) Assignee: Creative Plastic Concepts, LLC, Sycamore, OH (US)

( * ) Notice: Subject to any disclaimer, the term of this patent is extended or adjusted under 35 U.S.C. 154(b) by 0 days.

(21) Appl. No.: 15/484,423

(22) Filed: Apr. 11, 2017

(65) Prior Publication Data

US 2017/0290428 A1 Oct. 12, 2017

Related U.S. Application Data

(60) Provisional application No. 62/320,749, filed on Apr. 11, 2016.

(51) Int. Cl.

| | |
|---|---|
| ***A47B 96/02*** | (2006.01) |
| ***A47B 47/00*** | (2006.01) |
| ***A47B 47/04*** | (2006.01) |

(52) U.S. Cl.

CPC ..... *A47B 96/021* (2013.01); *A47B 47/0083* (2013.01); *A47B 47/045* (2013.01)

(58) Field of Classification Search

CPC . B29K 2711/00; B29K 2711/14; B29C 45/14; A47B 96/021; A47B 47/0083; A47B 47/045

USPC ..... 211/134, 135, 186, 188, 187, 71.01; 108/192, 193, 159, 158.11

See application file for complete search history.

(56) References Cited

U.S. PATENT DOCUMENTS

| | | | | | |
|---|---|---|---|---|---|
| 246,853 | A * | 9/1881 | Woods | B32L 327/12 | 144/361 |
| 1,336,973 | A * | 4/1920 | Levene | B65D 19/08 | 108/55.1 |
| 1,587,693 | A * | 6/1926 | Beland | A47L 19/02 | 211/153 |
| 1,919,439 | A * | 7/1933 | Little | A47F 5/13 | 211/133.2 |
| 2,760,650 | A * | 8/1956 | Franks | A47B 57/404 | 211/187 |
| 2,790,559 | A * | 4/1957 | Stephenson | A47B 96/028 | 108/108 |
| 2,845,187 | A * | 7/1958 | Bianchi | A47B 57/425 | 108/147.17 |
| 2,940,601 | A * | 6/1960 | Smith | A47B 57/425 | 108/152 |
| 3,094,848 | A * | 6/1963 | Albrecht | E02B 3/068 | 108/159 |

(Continued)

*Primary Examiner* — Jonathan Liu
*Assistant Examiner* — Devin K Barnett
(74) *Attorney, Agent, or Firm* — Jacob M. Ward; Ward Law Office LLC

(57) ABSTRACT

A shelf includes a main body with a plurality of support features formed therein. In one embodiment, each of the support features formed in the main body may include a board having an overmolded exterior. The board may have a plurality of apertures formed therethrough. The overmolded exterior extends through the apertures formed in the board. In another embodiment, each of the support features includes a removable board in an elongate recess that is secured in place by a cover. The boards may be wooden and add a desired strength and rigidity to the main body.

4 Claims, 6 Drawing Sheets

(56) References Cited

U.S. PATENT DOCUMENTS 3,168,365 A * 2/1965 Evans ..... A47B 57/16 108/109
3,365,761 A * 1/1968 Kalvig ..... B25H 3/04 211/65
3,463,325 A * 8/1969 Rogers ..... A47B 57/00 211/187
3,556,306 A * 1/1971 Shell ..... A47B 96/027 108/108
3,557,966 A * 1/1971 Skubic ..... A47B 81/007 211/24
3,602,372 A * 8/1971 Verrecchio ..... A47F 5/0853 206/8
3,603,551 A * 9/1971 Peterson ..... A47F 7/0028 211/70.6
3,889,619 A * 6/1975 Glassmeyer ..... B63B 25/18 114/201 R
3,921,804 A * 11/1975 Tester ..... B65D 83/0463 206/515
3,927,769 A * 12/1975 Maslow ..... F26B 25/18 211/153
3,986,462 A * 10/1976 Heft ..... A47B 96/02 108/188
4,082,882 A * 4/1978 Weinstein ..... B29C 70/088 422/286
4,107,833 A * 8/1978 Knight ..... E04H 5/10 220/592.1
4,119,208 A * 10/1978 Acker ..... B65G 1/06 211/134
4,121,718 A * 10/1978 Bannister ..... A47F 7/17 211/134
4,574,709 A * 3/1986 Lackey ..... A47B 87/0223 108/11
4,603,782 A * 8/1986 Fenwick ..... A47B 57/20 108/107
4,665,838 A * 5/1987 Minshall ..... A47B 47/021 108/157.13
D291,165 S * 8/1987 Ray ..... D6/675.2
4,696,406 A * 9/1987 Karashima ..... A47B 96/021 108/110
4,706,576 A 11/1987 James
4,706,824 A * 11/1987 Mercer ..... A47F 5/118 108/186
4,793,665 A * 12/1988 King ..... A47F 5/0043 211/40
4,843,975 A * 7/1989 Welsch ..... A47B 87/0223 108/192
4,917,235 A * 4/1990 Feiler ..... A47F 7/022 206/566
4,940,150 A * 7/1990 Spengler ..... A47B 87/0223 211/133.1
4,964,350 A * 10/1990 Kolvites ..... A47B 47/04 108/107
4,989,519 A * 2/1991 Welsch ..... A47B 47/04 108/192
4,993,545 A * 2/1991 Feiler ..... A47F 7/022 206/566
4,995,323 A * 2/1991 Kellems ..... A47B 96/00 108/157.13
5,027,961 A * 7/1991 Howitt ..... A47B 87/0253 211/188
5,199,582 A * 4/1993 Halstrick ..... A47B 96/021 169/10
5,264,062 A * 11/1993 Ohsumi ..... B27D 1/00 156/228
5,271,337 A * 12/1993 Kolvites ..... A47B 47/04 108/107
5,313,891 A * 5/1994 Suttles ..... A47B 47/022 108/108
5,338,592 A * 8/1994 Ohsumi ..... B29C 45/1671 428/106
5,437,165 A * 8/1995 White ..... A45C 11/20 62/457.1
D362,138 S * 9/1995 Sagol ..... D6/675.1
5,538,134 A * 7/1996 Pitesky ..... A61B 10/0035 206/438
5,579,703 A * 12/1996 King ..... A47B 87/0223 108/158.11
5,642,923 A * 7/1997 Meacham ..... B65D 19/44 108/106
5,671,753 A * 9/1997 Pitesky ..... A61B 17/205 600/556
D386,019 S * 11/1997 Grosfillex ..... D6/675.1
5,685,545 A * 11/1997 Quinton ..... A63F 9/0076 108/159
5,709,158 A * 1/1998 Wareheim ..... A47B 87/0246 108/180
5,806,689 A * 9/1998 Mays ..... A47F 1/12 108/108
D403,903 S * 1/1999 Calmeise ..... D6/705.1
5,863,479 A * 1/1999 Ohsumi ..... B29C 45/14811 156/153
5,931,553 A * 8/1999 Cohen ..... A47B 91/024 312/108
5,947,036 A * 9/1999 Cohen ..... A47B 49/004 108/110
5,964,163 A * 10/1999 Cohen ..... A47B 49/004 108/186
5,996,818 A * 12/1999 Boje ..... B01L 9/06 206/443
6,050,428 A * 4/2000 Hollander ..... A47B 96/021 211/135
6,059,115 A * 5/2000 Ovadia ..... A45C 11/16 206/562
6,065,407 A * 5/2000 Wang ..... A47B 54/545 108/110
6,079,339 A * 6/2000 Houk, Jr. ..... A47B 87/0223 108/157.13
6,083,601 A * 7/2000 Prince ..... B27N 3/005 160/236
6,152,314 A * 11/2000 Besanko ..... D06F 57/127 211/134
6,155,435 A * 12/2000 Malik ..... A47B 57/26 108/64
6,287,677 B1 * 9/2001 Ishihara ..... B27D 1/04 428/292.1
6,364,273 B1 * 4/2002 Otema ..... A47F 5/0043 248/235
6,548,753 B1 * 4/2003 Blackmon, Jr. .... H05K 7/20009 174/17 VA
6,601,715 B2 * 8/2003 Hardy ..... A47B 87/0246 211/188
6,764,625 B2 * 7/2004 Walsh ..... B27N 3/18 264/109
7,640,868 B2 * 1/2010 Morrison ..... F16F 15/08 108/91
7,910,067 B2 * 3/2011 Knight ..... B01L 9/06 211/71.01
8,360,410 B1 * 1/2013 Rockwood ..... A21C 11/00 269/289 R
8,763,819 B2 * 7/2014 Theisen ..... A47F 5/0025 211/119.003
9,468,312 B2 * 10/2016 Denby ..... A47F 5/0043
9,717,330 B2 * 8/2017 Reinhart ..... A47B 47/0091
2002/0043191 A1 * 4/2002 Sagol ..... A47B 57/50 108/193
2003/0132691 A1 * 7/2003 Ames ..... A47B 96/025 312/408
2003/0146180 A1 * 8/2003 Craft ..... A47B 87/0223 211/188
2003/0211595 A1 * 11/2003 Lee ..... B01L 9/06 435/283.1
2004/0003763 A1 * 1/2004 Wang ..... A47B 13/08 108/90
2004/0096642 A1 * 5/2004 Maruyama ..... B29C 44/461 428/304.4
2004/0159622 A1 * 8/2004 Craft ..... A47B 87/0246 211/153

(56) References Cited

U.S. PATENT DOCUMENTS

2004/0206714 A1* 10/2004 Jablow ..... A47B 45/00 211/153
2005/0263465 A1* 12/2005 Chung ..... A47B 96/021 211/90.02
2007/0023376 A1* 2/2007 Black ..... A47B 47/025 211/187
2008/0116156 A1* 5/2008 Park ..... A47B 87/0207 211/59.2
2008/0169256 A1* 7/2008 Shetler ..... A47B 96/021 211/153
2009/0107939 A1* 4/2009 Liao ..... A47F 5/10 211/134
2010/0326937 A1* 12/2010 Lin ..... A47B 47/021 211/135
2011/0056899 A1* 3/2011 Shinozaki ..... A47B 47/0083 211/153
2011/0097592 A1* 4/2011 Wang ..... B29C 45/14811 428/515
2012/0000871 A1* 1/2012 Troyner ..... A47B 47/021 211/134
2012/0082827 A1* 4/2012 Bae ..... B29C 51/082 428/196
2012/0091084 A1* 4/2012 Amaral ..... F25D 25/024 211/80
2012/0145663 A1* 6/2012 Dykstra ..... A47B 46/00 211/187
2012/0285915 A1* 11/2012 O'Quinn ..... A47B 96/021 211/134
2012/0292277 A1* 11/2012 Chikkakalbalu ..... A47B 96/027 211/94.02
2012/0298607 A1* 11/2012 Chen ..... A47B 47/024 211/186
2013/0001386 A1* 1/2013 Van Wingerden ..... A47G 29/1216 248/219.2
2013/0186847 A1* 7/2013 Kramer ..... A47F 5/00 211/134
2013/0286651 A1* 10/2013 Takeuchi ..... A47F 11/10 362/249.02
2014/0116973 A1* 5/2014 Buckley ..... A47F 5/00 211/134
2014/0262920 A1* 9/2014 Andrews ..... B65D 81/261 206/551
2014/0263136 A1* 9/2014 Reinhart ..... A47B 96/02 211/186
2014/0263137 A1* 9/2014 Reinhart ..... A47B 96/1416 211/186
2014/0353271 A1* 12/2014 Kruse ..... A47F 5/01 211/188
2015/0130335 A1* 5/2015 Jung ..... F25D 11/006 312/236
2015/0343838 A1* 12/2015 Nagase ..... B29C 43/18 428/195.1
2015/0351540 A1* 12/2015 Reinhart ..... A47B 47/0091 211/186
2015/0373935 A1* 12/2015 Anderson ..... A01G 31/02 47/63
2016/0051044 A1* 2/2016 Sabounjian ..... A47B 47/021 211/186
2016/0206119 A1* 7/2016 Denby ..... A47F 5/0043
2016/0331135 A1* 11/2016 Knudson ..... A47B 47/0091
2017/0001655 A1* 1/2017 Huang ..... B62B 3/003
2017/0164740 A1* 6/2017 Lindmark ..... A47B 96/024
2017/0203403 A1* 7/2017 Wang ..... B24B 7/07
2017/0280875 A1* 10/2017 Buckley ..... A47B 96/1441
2017/0290421 A1* 10/2017 Wood ..... A47B 47/0008
2017/0297597 A1* 10/2017 Chen ..... B62B 3/005

* cited by examiner

SHELF PRODUCT

CROSS-REFERENCE TO RELATED APPLICATIONS

This application claims the benefit of U.S. Provisional Application No. 62/320,749, filed on Apr. 11, 2016. The entire disclosure of the above application is hereby incorporated herein by reference.

FIELD

The disclosure generally relates to a shelf and, more particularly, to a shelf with wooden board supports.

BACKGROUND

Shelving systems, such as modular shelving systems, are known for storing and supporting items of all types. Typically, shelving systems contain several components that can be easily assembled to conform to a customer's needs. The shelving systems can include shelves, support posts, and connectors, for example.

It is desirable for each shelf to be formed from a lightweight material such as plastic to facilitate portability and ease of assembly of the shelving system. Many plastic shelving systems are shown in the prior art, including plastic shelving systems that fit together and assemble. For example, U.S. Pat. No. 4,706,576 to Barry James shows a rectangular shelving system capable of assembly into multiple configurations. Although plastic shelving systems are often lighter and more convenient to assemble than conventional shelving, plastic shelving systems often lack the same rigidity and strength as conventional shelving.

There is a continuing need for a shelf or shelving system that is lightweight. Desirably, the shelf also minimizes manufacturing costs and complexity of assembly while maximizing a strength and stiffness thereof.

SUMMARY

In concordance with the instant disclosure, a shelf that is lightweight, minimizes manufacturing costs and complexity of assembly, and maximizes the strength and stiffness thereof, has surprisingly been discovered.

In one embodiment, a shelf includes a main body and a plurality of support features. The support features are formed in the main body. Each of the support features include a board having an overmolded exterior. The shelf capable of standing on its own, or connected to a shelving structure.

In a further embodiment, a shelf includes a main body and a plurality of support features. The support features are formed in the main body. Each of the support features includes a board, wherein the board contains a plurality of apertures. The board has an overmolded exterior extending through the apertures. The shelf capable of standing on its own, or connected to a shelving structure.

In another embodiment, a shelf includes a main body and a plurality of support features disposed on the main body. Each of the support features includes a recess formed in the main body. A removable board is received within the recess. An insert is coupled to the main body and maintains the board within the recess. The shelf capable of standing on its own, or connected to a shelving structure.

DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
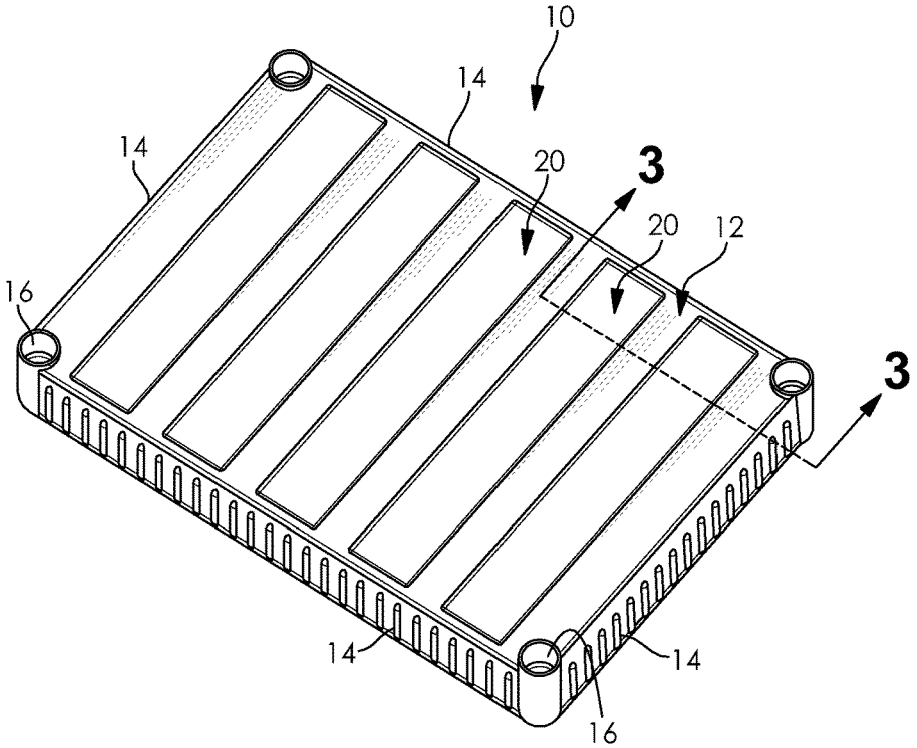
FIG. 1 is a top perspective view of a shelf according to one embodiment of the present disclosure.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical.

FIGS. 1-12 illustrate a shelf 10 according various embodiments of the present disclosure. The shelf 10 can be employed as a modular shelf for use in a modular shelving system, for example. The shelf 10 may cooperate with other components such as support posts to form the modular shelving system. However, it is understood the shelf 10 can be employed as a standalone platform or crate unit. All dimensions and materials identified are merely illustrative in nature, and should not be considered limiting unless otherwise disclosed.

The shelf 10 includes a main body 12 having walls 14. The walls 14 are integrally formed with the main body 12 and extend therefrom. In the embodiments shown, the main body 12 is substantially rectangular and has four corners. Other shapes for the shelf 10 may also be selected by a skilled artisan within the scope of the present disclosure.

The main body 12 includes corner openings 16. The corner openings 16 are formed therein for receiving posts or supports, and for facilitating stacking of the shelf 10. While four openings 16 are illustrated, more than four or less than four corner openings 16 can be contemplated for use, depending on the overall shape of the main body 12 selected.

The main body 12 is formed from a lightweight plastic material such as a polypropylene plastic material, by a molding process such as injection molding, as nonlimiting examples. It should be understood, the shelf 10 can be formed from any suitable material, including other thermoplastic materials such as polyethylene, for example, and non-thermoplastic materials such as foam or metal, for example. Any suitable processes for forming the shelf 10 may also be employed, as desired.

Figure 2:
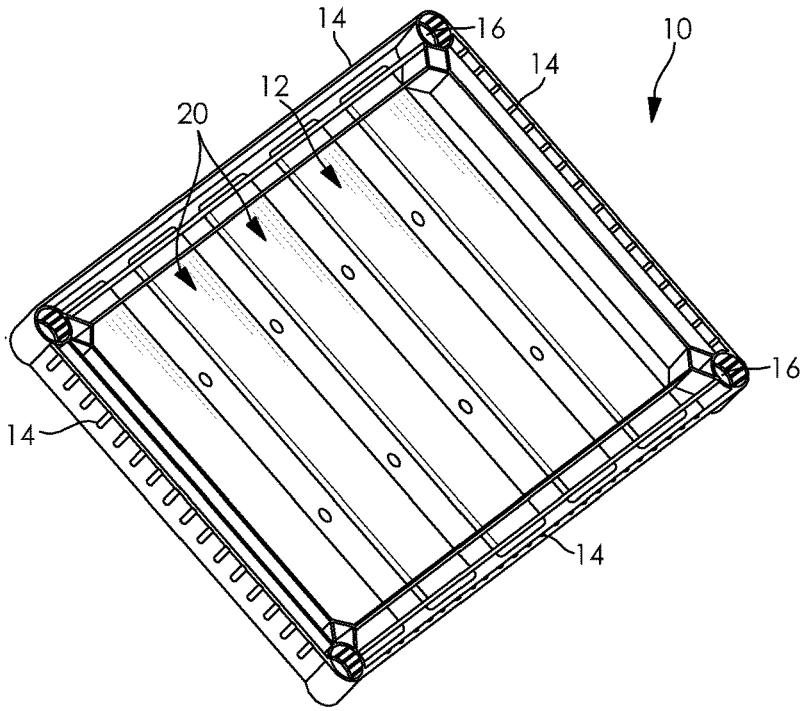
FIG. 2 is a bottom perspective view of the shelf shown in FIG. 1
Figure 3:
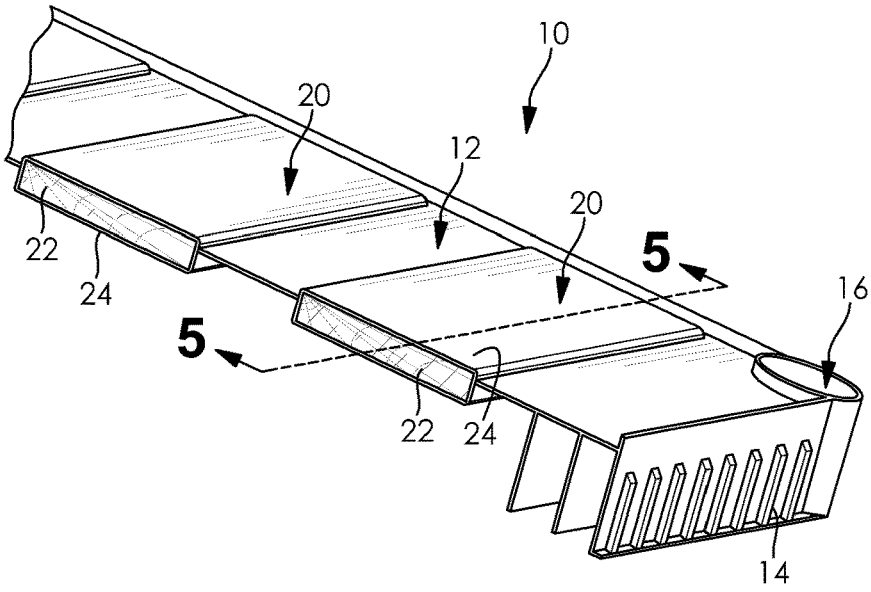
FIG. 3 is a fragmentary cross-sectional top perspective view of the shelf shown in FIG. 1, and taken along the section line 3-3.

With further reference to FIGS. 1-12, the shelf 10 includes support features 20 disposed within the main body 12. The support features 20 extend substantially parallel to each other along a width of the main body 12 (as shown in FIGS. 1-3) or along a length of the main body 12 (as shown in FIGS. 6-9 and 11-12). Five support features 20 are illustrated in the embodiment shown. However, it should be appreciated that more or fewer than five support features 20 can be employed, as desired.

In the embodiment illustrated in FIGS. 1-5, each of the support features 20 include a board 22. The board 22 is a wood board such as plywood, hardwood board, or medium density board, as non-limiting examples. However, other materials for the board 22 may be selected by a skilled artisan within the scope of the present disclosure.

The board 22 may have an overmolded exterior 24. The overmolded exterior 24 is a plastic exterior that is molded over the board 22 by an overmolding process. The overmolded exterior 24 can be formed by other materials, as desired. The overmolded exterior 24 of each of the support features 20 may be integrally formed with the main body 12 in an overmolding operation. For example, the board 22 can be positioned in a mold for forming the main body 12. The molding material, such as a thermoplastic, is then used with the mold to form both the main body 12 and the overmolded exterior 24, over the board 22. The shelf 10 is thereby provided as an integral unit.

In another embodiment, the overmolded support features 20 can be formed separately from the main body 12, through a separate injection molding process, and subsequently coupled thereto with mechanical or adhesive fasteners.

Figure 4:
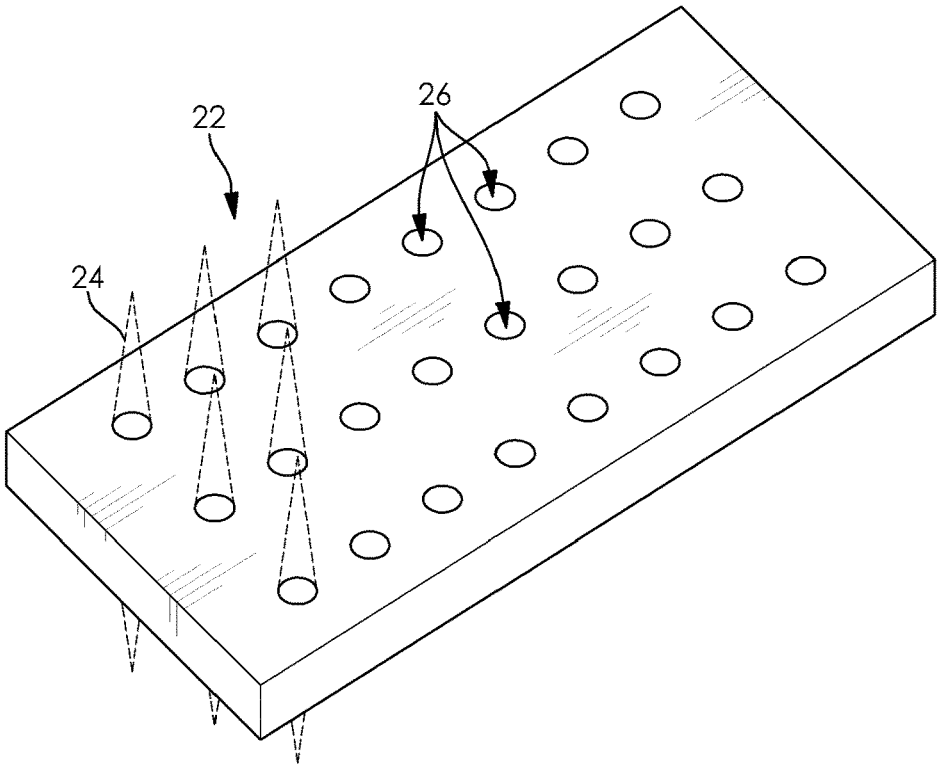
FIG. 4 is a top perspective view of a wooden board support with apertures that is employed with the shelf shown in FIGS. 1-3.
Figure 5:
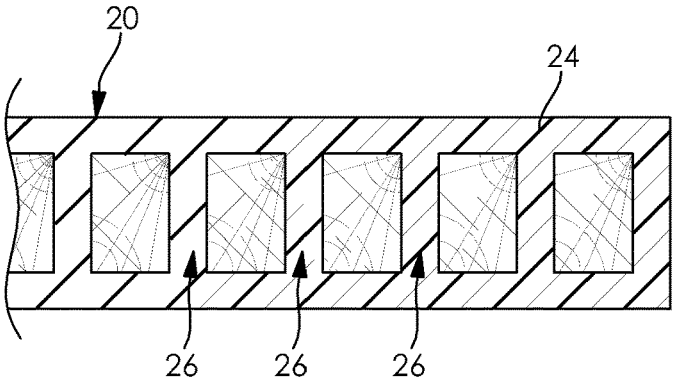
FIG. 5 is a fragmentary cross-sectional side elevational view of the shelf shown in FIG. 1-3, and taken along section line 5-5 in FIG. 3.

As illustrated in FIGS. 4 and 5, in certain embodiments the board 22 may include a plurality of apertures 26 formed therein. The apertures 26 can be formed by a punch-press or a drill press, for example, prior to the overmolding operation. During the overmolding operation, the overmolded exterior 24 extends through the apertures 26 between opposing surfaces of the board 22. Accordingly, the overmolded exterior 24 formed on one surface of the board 22 is continuous with the overmolded exterior 24 formed on the opposing surface of the board 22 through the apertures 26. The strength and integration of the board 22 with the remainder of the shelf 10 is thereby facilitated.

As shown in FIG. 4, the apertures 26 may be formed in a grid arrangement on the board 22. However, it should be understood that any number of apertures 26 can be formed in the board 22 to facilitate the increase in strength, as desired.

To assemble and form the shelf 10, the boards 20 are positioned in the mold for forming the main body 12. The apertures 26 can be pre-formed into the board 22 prior to positioning the boards 22 in the mold. A molding material, such as thermoplastic, is then disposed or injected into the mold. The overmolded exterior 24 is formed by the molding material flowing over the boards 22, and in certain embodiments through the apertures 26 of the boards 22, during the overmolding process.

Advantageously, the support features 20 including the board 22 maximize an overall strength, stiffness, and rigidity of the shelf 10, while maintaining a lightweight shelf 10.

It should be appreciated that the apertures 26 formed in the board 22 can also be employed to guide locating pins of the mold therein. The apertures 26 used to guide the locating pins of the mold facilitate proper positioning of the boards 22 within the mold. The overmolded exterior 24 extending through the apertures 26 further maximizes an overall strength, stiffness, and rigidity of the shelf 10.

FIGS. 6-12 show the shelf 10 according to further embodiments of the present disclosure. It should be appreciated that the recessed and covered embodiments of FIGS. 6-12 may be employed separately, or together with, the overmolded embodiments of FIGS. 1-5, and the shelf 10 may include both sets of features, as desired.

In these further embodiments, the support features 20 of the shelf 10 include elongate recesses 28 that are formed in the main body 12. The shape of each of the recesses 28 corresponds in shape to one of the boards 22. In operation, the recesses 28 receive the boards 22.

Figure 6:
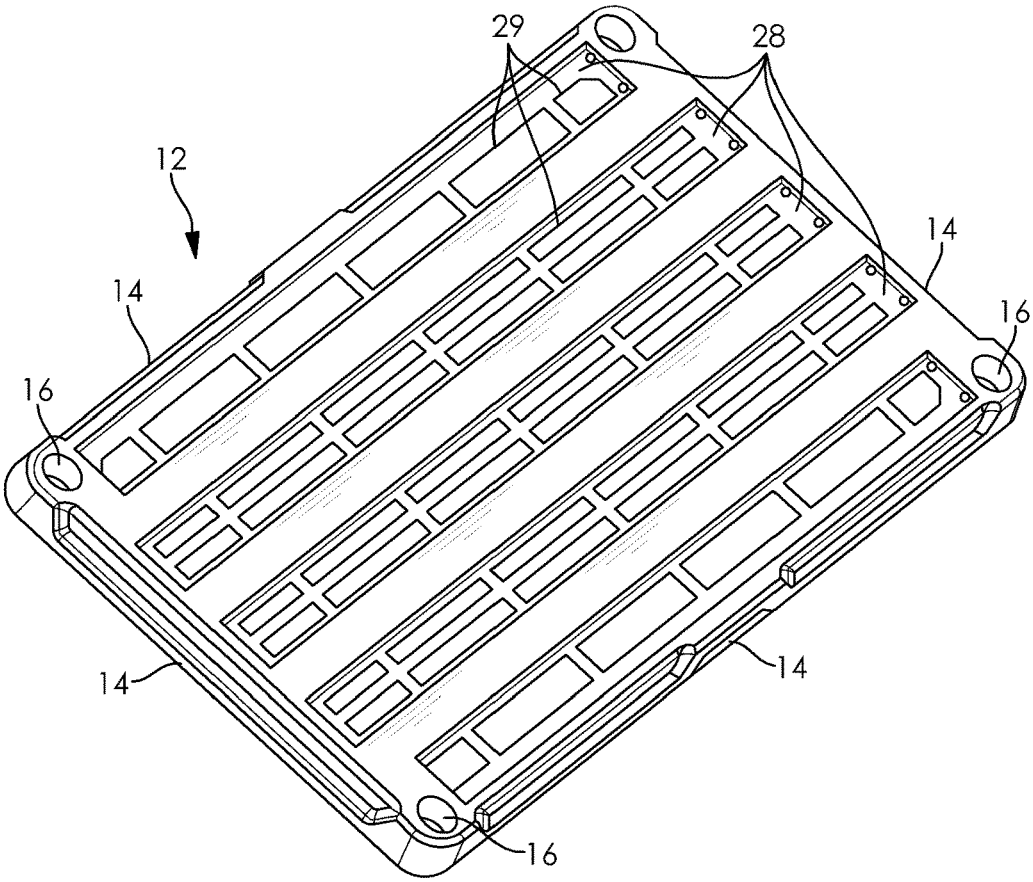
FIG. 6 is a top perspective view of a shelf according to another embodiment of the present disclosure, a main body of the shelf having recesses for receiving wooden board supports, openings to optimize material usage, and apertures for receiving tabs of a cover.
Figure 7:
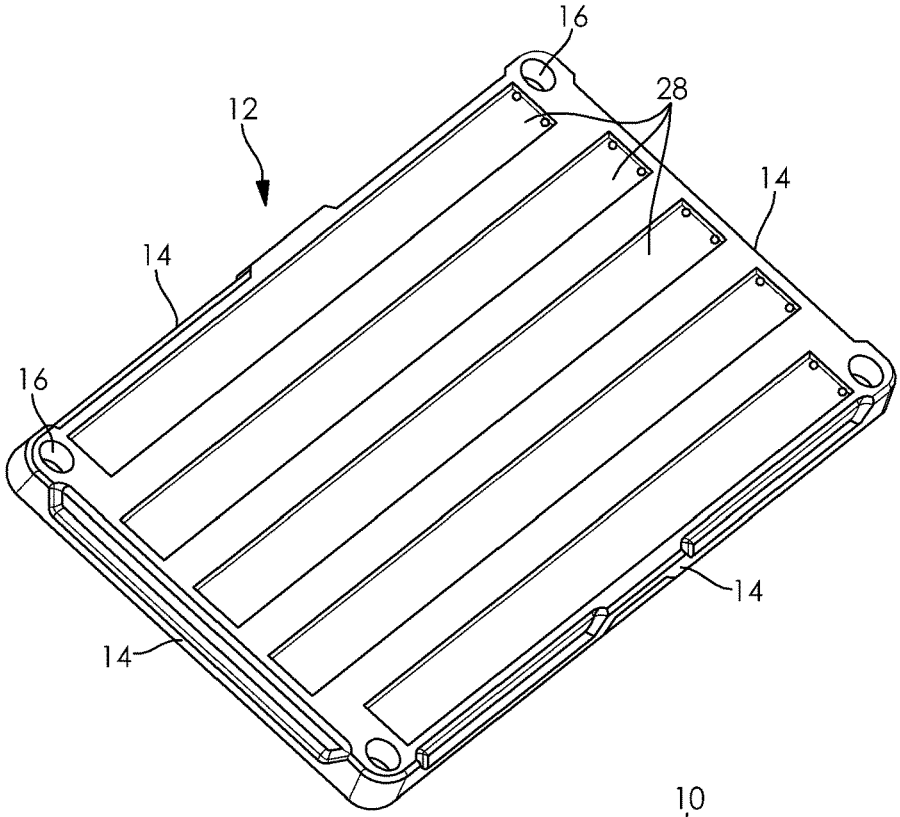
FIG. 7 is a top perspective view of a shelf according to a further embodiment of the present disclosure, a main body of the shelf having recesses and apertures for receiving tabs of a cover.
Figure 8:
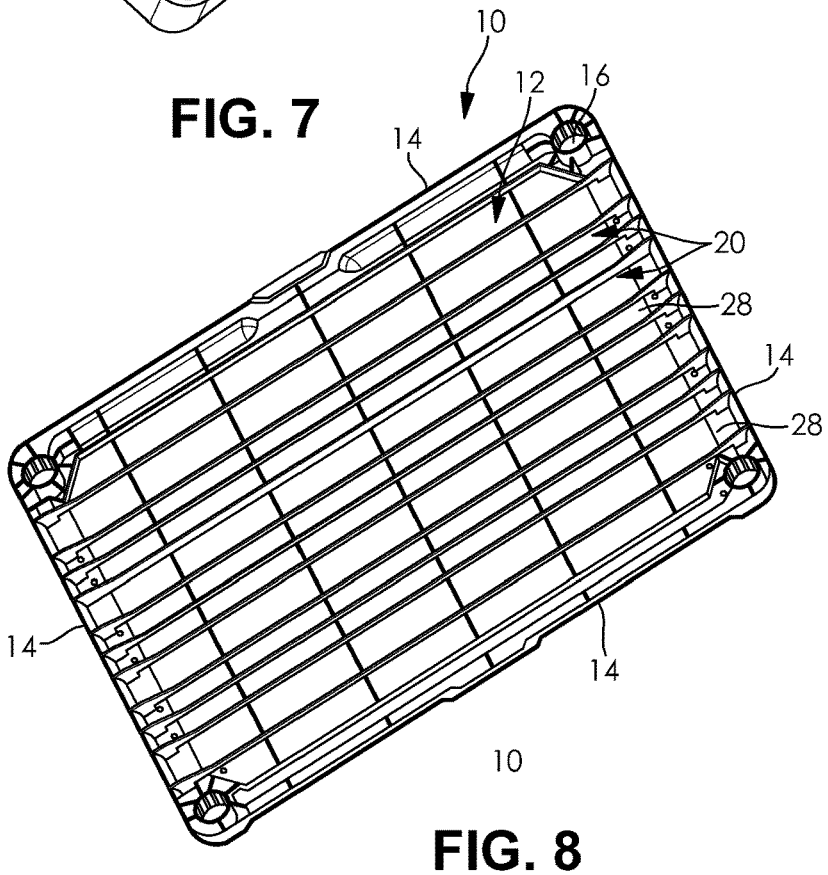
FIG. 8 is a bottom perspective view of a shelf shown in FIG. 7.
Figure 9:
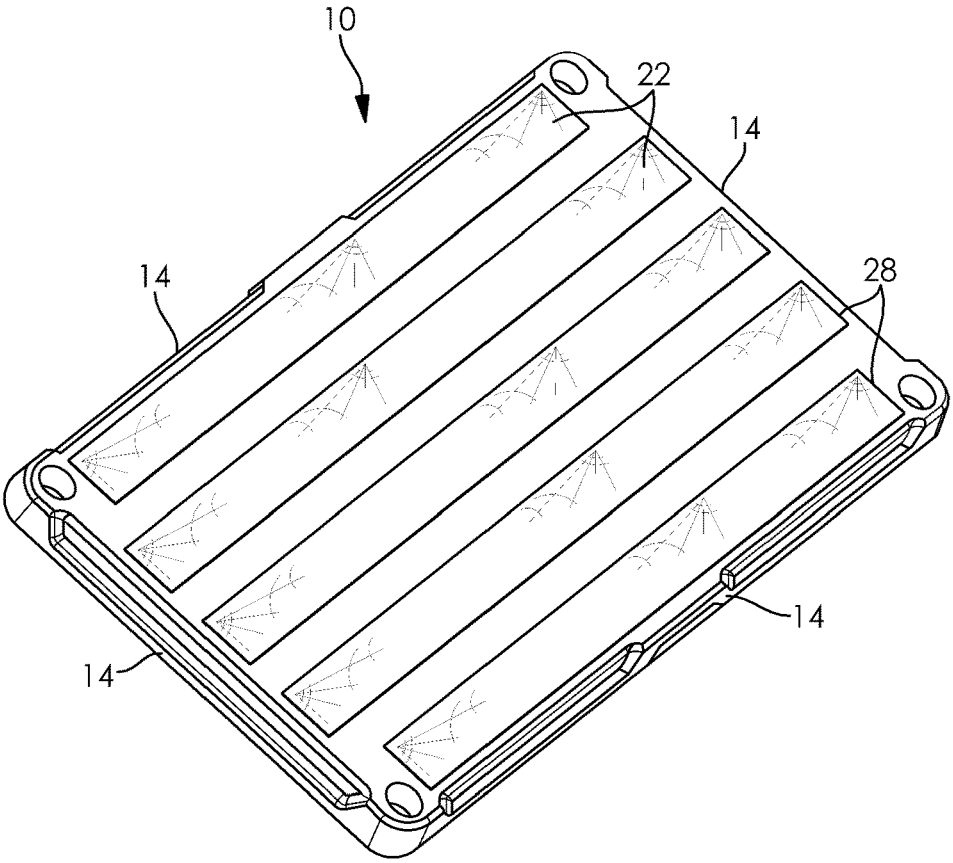
FIG. 9 is a top perspective view of a shelf as shown in FIGS. 6-8 with wooden board supports inserted into the recesses.

As illustrated in FIG. 6, additional holes or openings 29 can be formed in the recesses 28. The use of the additional openings 29 to minimize a cost to manufacture the shelf 10 and minimize an overall weight of the shelf 10. However, the recesses 28 can also be formed without the openings 29, as illustrated in FIG. 7.

With renewed reference to FIGS. 6-12, each of the support features 20 further include an insert 30. The insert 30 is positioned over the board 22 and received by the recess 28. The insert 30 is coupled to the main body 12 to maintain and secure the board 22 within the recess 28.

In particular examples, an outer surface of the insert is substantially flush with the outer surface of the remainder of the main body 12, to thereby create a uniform outer surface of the resulting shelf 10. In these examples, a depth of each of the elongate recesses 28 may be greater than a height of each of the boards 22 disposed within the recesses 28 by a dimension equivalent to a thickness of the insert 30. It should be understood that such dimensions advantageously result in an abutting of the boards 22 to both the bottom of the recesses 28 and the underside of the inserts 30, without the forming of any gaps therebetween.

Figure 10:
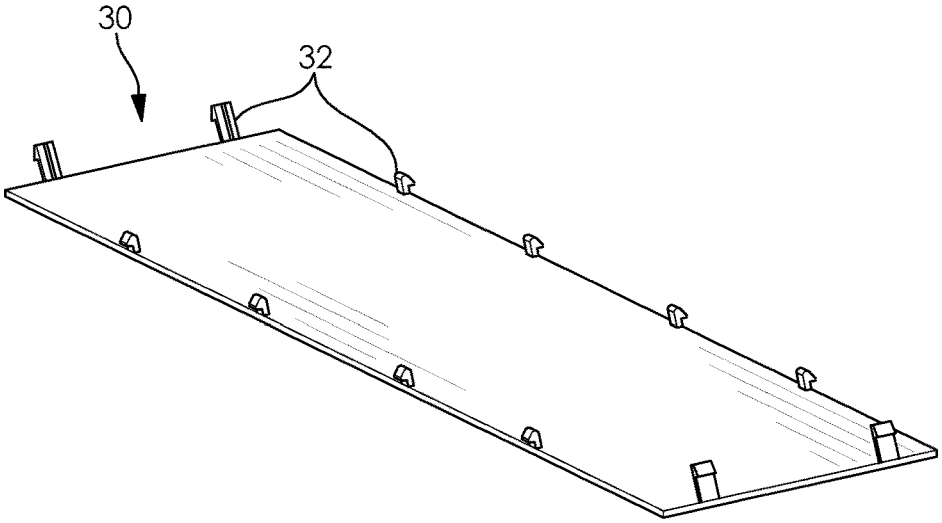
FIG. 10 is a bottom perspective view of a cover for use with the shelf shown in FIGS. 6-9.
Figure 12:
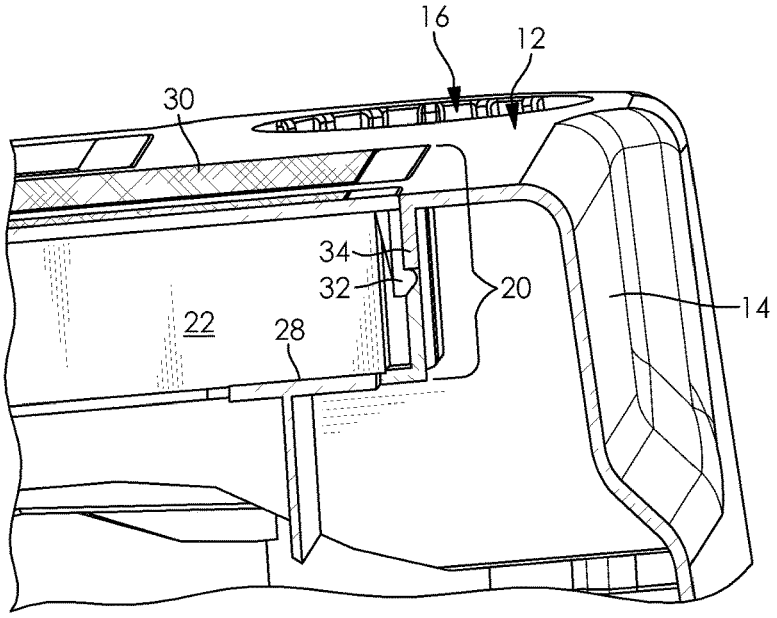
FIG. 12 shows an enlarged top perspective cross-sectional view of inserts and boards cooperating with a main body of the shelf taken along the section line 12-12 in FIG. 11.

In certain embodiments, shown in FIG. 10, the insert 30 can include a plurality of tabs 32 formed adjacent a perimeter of the insert 30. The tabs 32 are configured to engage with an inner lip 34 formed on the main body 12, as shown in FIG. 12. For example, each of the tabs 32 may have a hooked end that catches an edge of the inner lip 34. The inner lip 34 may circumscribe the recess 28, or may be defined by the openings 29 formed in the recess 28, as non-limiting examples.

In other embodiments, the insert 30 can be coupled to the main body 12 by other suitable means such as a welding, friction welding, press fitting the inserts 30 with the main body 12, or by employing mechanical coupling devices such as screws, nails, pins, and the like. The use of chemical adhesives to couple the insert 30 to the main body 12, and thereby secure the support 20 within the recess 28, is also contemplated and within the scope of the present disclosure.

Figure 11:
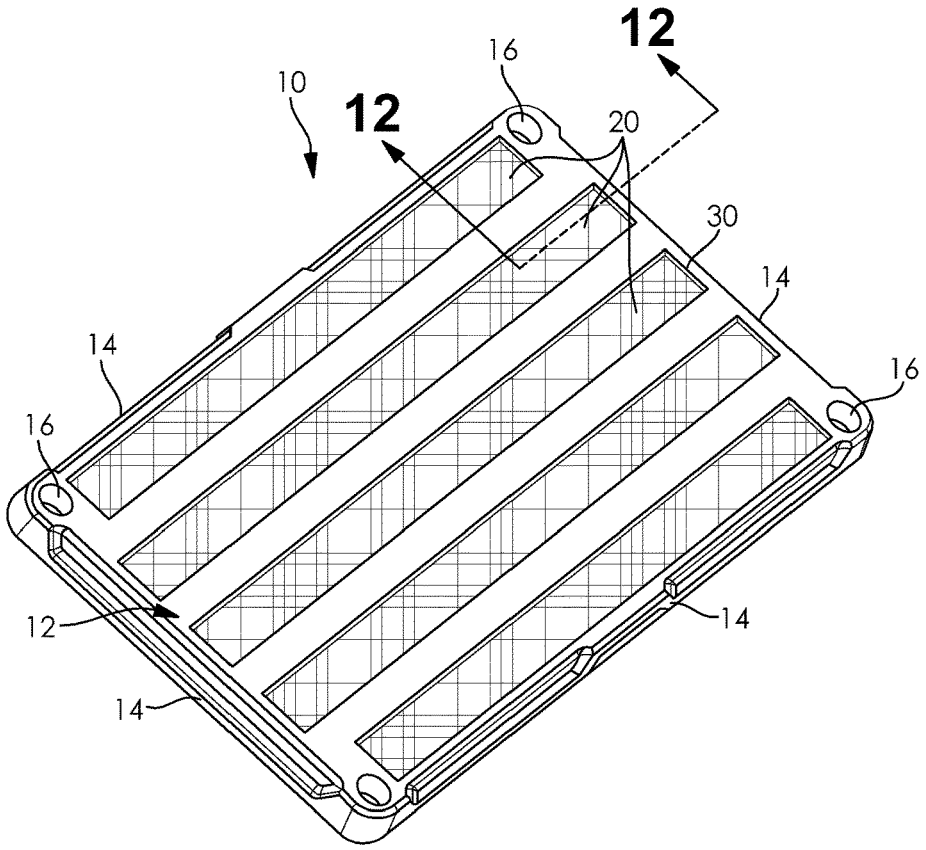
FIG. 11 is a top perspective view of the shelf as shown in FIGS. 6-9 with the cover of FIG. 10 affixed to each of the recesses.

As shown in FIGS. 11-12, each of the inserts 30 of the support features 20 can include surface features formed on an outer surface thereof. For example, the surface features can include a texturing or embossed pattern formed on the outer surface of the inserts 30. The surface features militate against slippage or movement of items or products stored on the shelf 10.

To assemble and form the shelf 10 illustrated in FIGS. 6-12, the main body 12 is formed by molding or other suitable process. The main body 12 is formed with the elongate recesses 28 therein. The boards 22 are inserted into and received by the recesses 28. The inserts 30 are then coupled to the main body 12 to cover the boards 22 and recesses 28.

Advantageously, the boards 22 add a strength, rigidity, and stiffness to the shelf 10. It is understood that the boards 22 can also be removed from the shelf 10 to minimize an overall weight of the shelf 10, for example, during storage and shipping of the shelf 10, as desired.

While certain representative embodiments and details have been shown for purposes of illustrating the invention, it will be apparent to those skilled in the art that various changes may be made without departing from the scope of the disclosure, which is further described in the following appended claims.

What is claimed is:

1. A shelf, comprising:

a thermoplastic main body having a plurality of corner openings formed therein for receiving upright support posts, and a plurality of support features;

the support features including:

a plurality of boards spaced apart along a length of the main body, wherein the boards provide additional support so the shelf can hold more weight, and an overmolded exterior thermoplastic covering disposed on each of the plurality of boards, each of the boards having a top surface and a bottom surface opposite the top surface, the top surface disposed adjacent a top of the shelf, the bottom surface disposed adjacent a bottom of the shelf;

wherein each of the top surfaces and each of the bottom surfaces of each of the boards is entirely covered by the overmolded exterior thermoplastic covering and rigidly held in place in the thermoplastic main body by the overmolded exterior thermoplastic covering along a length of each of the boards;

wherein each of the boards has a plurality of apertures formed therethrough extending from each top surface to each bottom surface respectively, the thermoplastic of the overmolded exterior thermoplastic covering also disposed through the apertures and connecting a first portion of the overmolded exterior thermoplastic covering the top surface of each of the boards with a second portion of the overmolded exterior thermoplastic covering the bottom surface of each of the boards, and wherein each of the boards is wooden, and the thermoplastic main body and the overmolded exterior thermoplastic covering are an integral unit that is formed in an overmolding operation on the plurality of boards, whereby the boards are securely affixed within the thermoplastic main body.

2. The shelf of claim 1, wherein the main body is rectangular and has four corner openings from said plurality of corner openings, wherein each of the four openings is spaced apart and configured to receive a separate support post.

3. The shelf of claim 1, wherein the boards extend substantially parallel to each other along the length of the main body.

4. The shelf of claim 1, wherein the apertures are arranged in a grid pattern across each of the boards.

* * * * *